US009907424B2

(12) United States Patent
Bassetti

(10) Patent No.: US 9,907,424 B2
(45) Date of Patent: Mar. 6, 2018

(54) UPPER GARMENT HOLDING ACCESSORY

(71) Applicant: Elisa P. Bassetti, Woodinville, WA (US)

(72) Inventor: Elisa P. Bassetti, Woodinville, WA (US)

( * ) Notice: Subject to any disclaimer, the term of this patent is extended or adjusted under 35 U.S.C. 154(b) by 0 days.

(21) Appl. No.: 15/209,624

(22) Filed: Jul. 13, 2016

(65) Prior Publication Data

US 2017/0013986 A1 Jan. 19, 2017

Related U.S. Application Data

(60) Provisional application No. 62/191,680, filed on Jul. 13, 2015.

(51) Int. Cl.
*A47G 25/90* (2006.01)
*A41B 1/00* (2006.01)

(52) U.S. Cl.
CPC ..... *A47G 25/90* (2013.01); *A41B 1/00* (2013.01)

(58) Field of Classification Search
CPC ..... A47G 25/80–25/907; A41B 1/00
See application file for complete search history.

(56) References Cited

U.S. PATENT DOCUMENTS 349,529 A 9/1886 Shelby
526,789 A * 10/1894 Peacock ..... A47G 25/90 190/13 R
658,801 A * 10/1900 Platt ..... A47G 25/905 223/111
738,575 A * 9/1903 Seitz ..... A47G 25/905 223/111
975,246 A 11/1910 Johnson
1,687,129 A * 10/1928 Henninger ..... A47G 25/746 211/124
4,159,773 A 7/1979 Losenno
4,892,239 A * 1/1990 Tomasi ..... A47G 25/90 223/111
4,898,309 A 2/1990 Fisher
5,624,154 A 4/1997 Kishi
5,630,534 A 5/1997 Maier
5,813,550 A * 9/1998 Sheehan ..... A47F 5/0807 211/87.01
6,419,131 B1 7/2002 Rix
8,070,025 B1 * 12/2011 Nelson ..... A47G 25/14 211/85.2
2011/0049200 A1 * 3/2011 Rodberg ..... A47G 25/14 223/85

* cited by examiner

*Primary Examiner* — Ismael Izaguirre
(74) *Attorney, Agent, or Firm* — Dean A. Craine

(57) ABSTRACT

An accessory used to assist a disabled person to put on an upper garment, such as a coat, sweater or vest with two armholes. The accessory includes a rigid round member and a flexible arm each securely attached to the opposite ends of a rigid elongated base. The round member is configured to vertically support the upper garment when draped thereon and still allow disengagement of the upper garment from the round member when the upper garment is pulled downward. Attached to the distal end of the flexible arm is a clamping member configured to temporarily grip the upper, front edge or the lapel of the upper garment. The flexible arm may be bent and twisted in three axes enabling the upper garment to be stretched and held with its two armholes open and oriented at different locations to accommodate the restricted arm and shoulder movements of different users.

10 Claims, 8 Drawing Sheets

UPPER GARMENT HOLDING ACCESSORY

This utility patent application is based on and claims the filing date benefit of U.S. provisional patent application (Application No. 62/191,680), filed on Jul. 13, 2015.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

The present invention relates to devices used to assist elders or disabled individuals putting on an upper garment with armholes, such as a vest, sweater or coat.

2. Description of the Related Art

Have you experienced or watched an individual with an injured shoulder or elbow put on or take off an upper garment with armholes? Have you watched a visually impaired individual when holding an upper garment struggle trying to find both armholes on the upper garment? Not only can it be difficult for them to insert their arms into the armholes, but sometimes after inserting the arms into the armholes, they may also find it difficult to untwist or unfold the upper garment's collar.

Many elders have reduced coordination, flexibility and poor vision, making it difficult for them to put on an upper garment with armholes. They sometimes have difficulty simultaneously holding the upper garment vertically with the upper garment's inside surface sufficiently stretched so each arm can be inserted into an armhole.

What is needed is a dressing accessory that temporarily holds an upper garment vertically with the upper garment's inside surface facing outward and sufficiently stretched so the upper garment's two armholes are expanded, spaced apart, visible and easily accessible. What is also needed is a dressing accessory that allows the user to hold the upper garment vertically and adjust the size, shape and elevation of the armholes relative to the user and to each other to accommodate the needs of users with different impairments.

SUMMARY OF THE INVENTION

Disclosed is an accessory for assisting a disabled person with putting on an upper garment with two armholes, such as a vest, sweater or coat. The accessory includes an elongated base with a flexible arm and a rigid round member each securely attached to the opposite ends of the elongated base. The elongated base is held substantially horizontally adjacent to a vertical wall or door. The flexible arm and round member extend outward from the same side of the elongated base. The flexible arm can be twisted 360 degrees and can be bent upward, downward, inward and outward and temporarily repositioned. Attached to the distal end of the flexible arm is a clamping member configured to temporarily grip the upper garment's shoulder area, lapel or the front edge of the upper garment so the upper garment is held vertically with its inside surface facing outward. In the preferred embodiment, the flexible arm is adjusted so the armhole located adjacent to the clamping member is positioned below the round member and the upper garment is partially stretched so both armholes are expanded, visible and easily accessible.

The round member, which is found in one embodiment is approximately three inches in diameter, extends outward and mounted to the end of the elongated base opposite the flexible arm. In one embodiment, the outer surface of the round member is configured or textured to temporarily grip or prevent sliding of the upper garment's shoulder area or collar when deposited over the round member. The round member is also configured to be sufficiently smooth to allow the upper garment to slide over the round member when the upper garment is tugged or pulled upward or downward by the user.

During use, the upper garment is positioned vertically adjacent with the upper garment's collar positioned near the elongated base. The upper garment is typically made of cotton, wool, nylon or polyester or a blend thereof and may or may not include a cotton, wool or polyester liner. The upper garment is held vertically with its back surface facing the wall, door or support surface and its inside surface facing outward. The armhole that is most difficult to access by the user's arm (called a first armhole) is identified. The upper garment's shoulder area or lapel adjacent to the first armhole is extended over the round member. A sufficient amount of the shoulder area or lapel must be placed over the round member so the upper garment 90 hangs vertically from the round member.

After placing the upper garment around the round member, the upper garment is then gently stretched horizontally so that the upper garments front opening is facing outward. The clamping member is then attached to the upper garment's lapel or front edge located adjacent to the second armhole. The flexible arm and the clamping member are both adjustable and may be bent or rotated to sufficiently stretch the upper garment so both armholes are rotated, extended or opened and face outward. Usually, the flexible arm extends downward, so the second armhole is slightly below the first armhole supported by the round member, so that user must only rotate his or her feet and his or her hips and extend his or her non-disabled arm downward into the second armhole.

To don the upper garment, the user turns her back towards the inside surface of the upper garment held by the accessory. The user then backs up and extends the disable arm into the first armhole located directly below the round member. The user then rotates and fully extends the opposite arm into the second armhole below the flexible arm. As the arm is inserted into the second armhole, light downward pressure is applied to the clamping member and to the round member causing the entire upper garment to detach from the accessory.

The elongated member may be attached in a fixed position on a vertical wall or support surface, or it may be attached to at least one vertical hanger that extends over the top edge of a door to temporarily hold the elongated member over the door. Alternatively, the elongated member may be attached to a vertical member that allows the elongated member to be raised or lowered over the support surface.

The flexible arm may be one piece or made of multiple pieces. In each embodiment, different sections of the flexible arm may be bent or twisted at different angles to allow the user to adjust the spacing along three axes (X, Y and Z) between the clamping member and the round member to accommodate the needs of different individuals. The flexible arm may be attached to a rotating adapter mounted on one end of the elongated base enabling the flexible arm to be selectively extended downward from the elongated base and out of the way when not in use.

Also, the round member may be a spherical or oval shape structure. The round member may be directly attached to the elongated base or attached to a short rod that attaches to the elongated base.

The elongated base may include holes that enable it to be attached directly to a vertical surface. Alternatively, the elongated base may attached to a hanger assembly that allows the elongated base to be hung from the top edge of a door.

DESCRIPTION OF THE PREFERRED EMBODIMENT(S)

Figure 1:
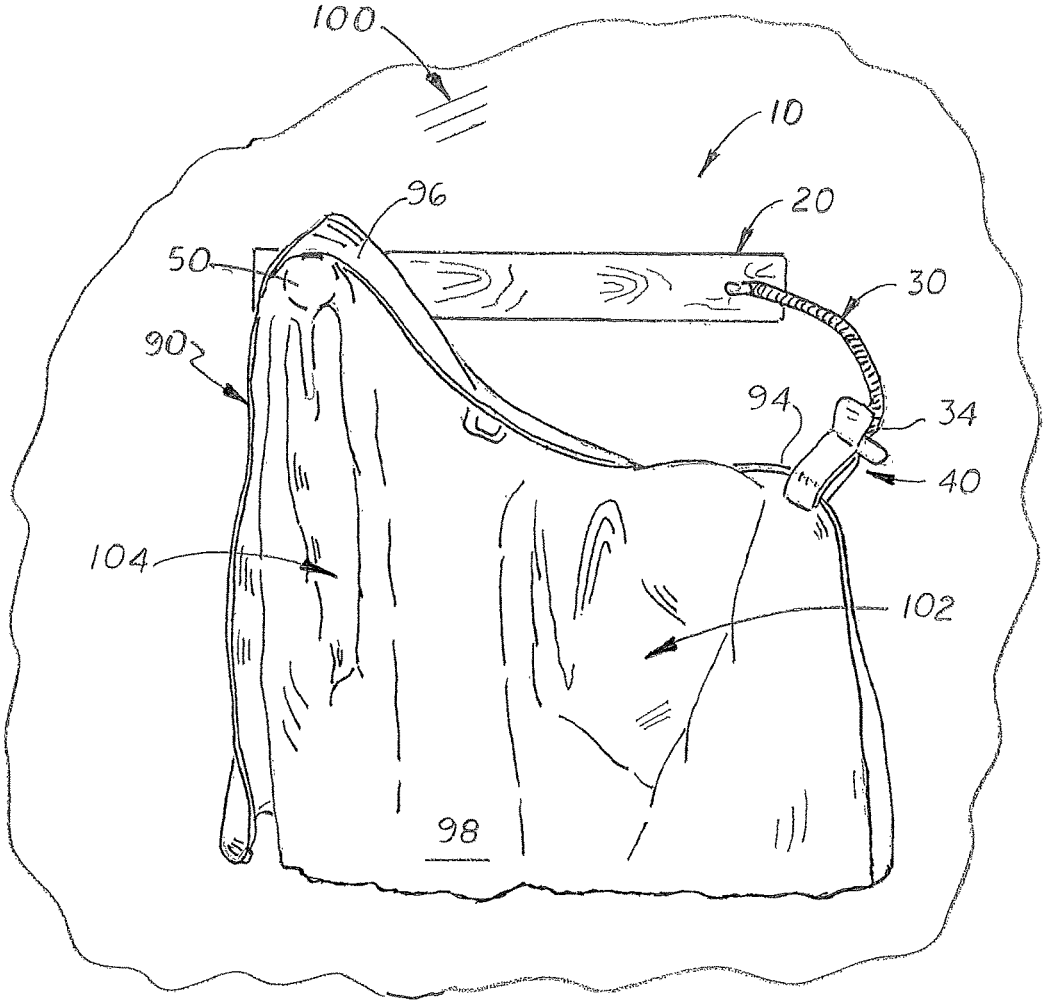
FIG. 1 is an illustration showing the upper garment holding accessory mounted on a vertical surface and showing a coat attached to the accessory with its inside surface facing outward with the two armholes exposed.

Referring to the Figures, there is shown an accessory 10 for assisting a disabled person when putting on an upper garment 90 with two armholes 92, 94, such as a vest, sweater, coat or bathrobe. The accessory 10 includes a rigid elongated base 20 with a flexible arm 30 and a rigid round member 50 each securely attached to the elongated base 20 at a first predetermined distance. The elongated base 20 is held adjacent to a vertical wall or door 100. The flexible arm 30 and the round member 50 extend outward from the elongated base 20.

Attached to the distal end 34 of the flexible arm 30 is a clamping member 40 configured to temporarily grip the shoulder area or lapel 94 on an upper garment 90. The round member 50, which two to four inches in diameter, includes a smooth, slightly textured outer surface 52. The round member 50 is securely mounted to the end of the elongated base 20 opposite the flexible arm 30. The outer surface 52 of the round member 50 must be sufficiently smooth to allow the upper garment 90 to slide freely over the round member 50 when the upper garment is pulled from the round member 50.

In one embodiment, the elongated base 20 is a straight, solid rectangular bar with two holes 26, 28, formed near its opposite ends 22, 24, respectively. In one embodiment, the elongated base 20 has two holes 29 formed near its opposite ends 22, 24 that receives two threaded screws 120 that attach the elongated base 20 in a fixed position to a vertical wall or door 100.

The round member 50 is mounted to the end of a threaded post 54 that fits into the bore 26 formed on the elongated base 20. A threaded nut 56 attaches to the end of the threaded post 54 to hold the post 54 and the round member 50 in a fixed position on the elongated base 20. It should be understood that the bore 26 may include internal threads (not shown) that connect directly to a threaded post 54.

The flexible arm 30 includes a proximal end and a distal end. Mounted on the distal end is a clamping member 40. The proximal end includes a threaded post 34 that fits into the hole 28 formed on the elongated base 20. A threaded nut 36 attaches to the threaded post 34 to securely hold the proximal end of the flexible arm 30 on the elongated base 20. It should be understood that a bore includes internal threads (not shown) may be used in place of the hole 28 and nut 36 that connects to the threaded post 34.

The flexible arm 30 is made of a plurality of interconnected twisting sections that enable the user to twist and bend the flexible arm 30 in different angles. In the embodiment shown, the flexible arm 30 is approximately ½ inch in diameter and 12 to 14 inches in length.

The clamping member 40 includes jaws that are biased in a closed position and configured to grip the upper garment's lapel or front edge when the upper garment's opposite shoulder area 96 is draped over the round member 50. The clamping member 40 may be twisted on the end of the flexible arm 30 so the second armhole 102 on the upper garment 90 may be optimally positioned to allow the user to easily and comfortably insert her arm into the second armhole 102.

In one embodiment, the elongated member 20 has a flat inside surface which enables the elongated member 20 to rotate up to 360 degrees over a vertical member 110 affixed or held against a vertical surface 100. In one embodiment, the elongated base 20 is a straight, c-shaped channel with open or closed opposite ends. In both embodiments, the elongated member 20 may include a transversely aligned keyway 140 configured to fit over the vertical member 110 and lock the elongated member 20 to the vertical member 110.

Figure 5:
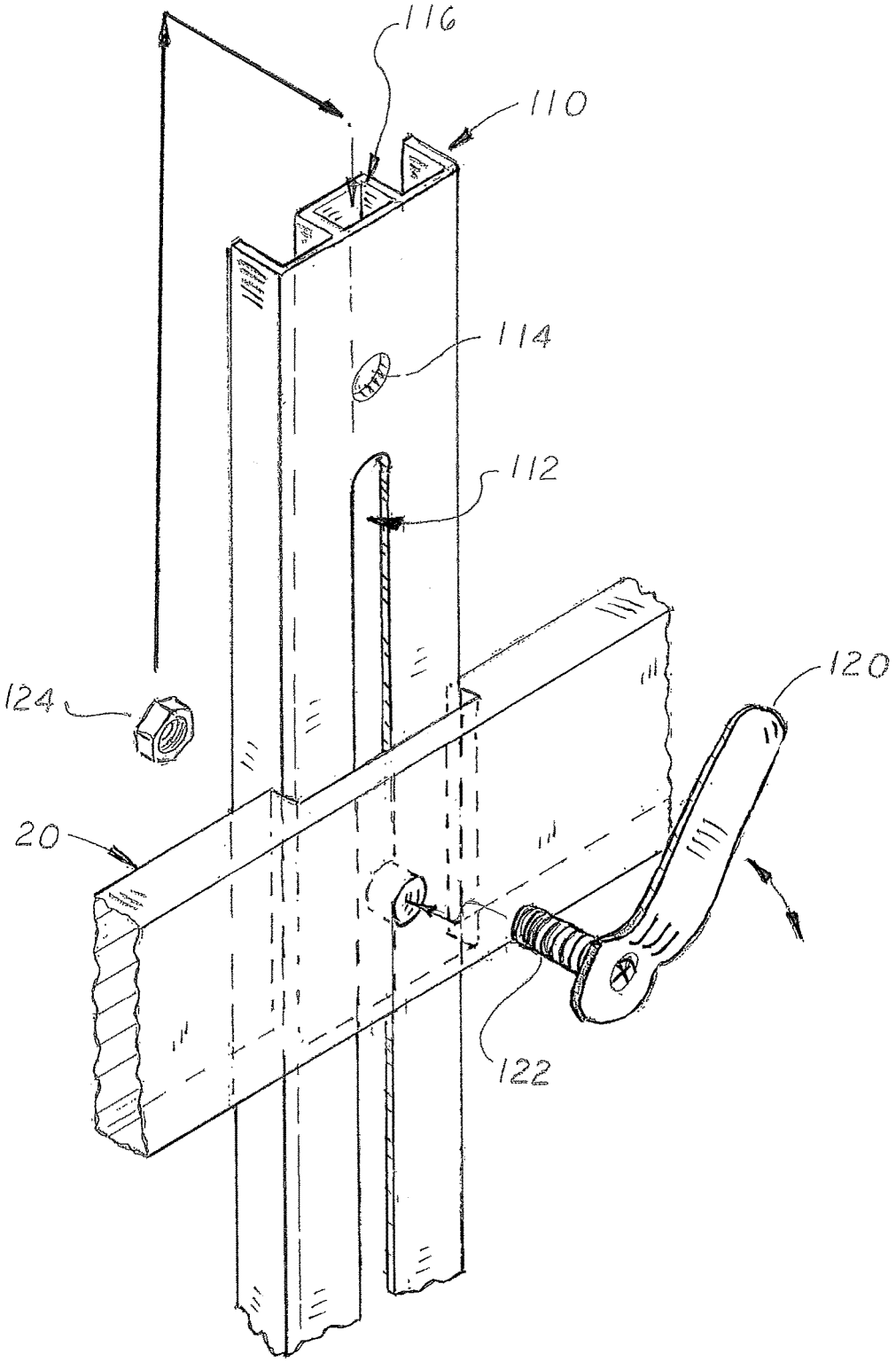
FIG. 5 is a partial perspective view of the vertical member and the elongated member with a transversely aligned key-way formed in the elongated base that enables the elongated base to slide over a vertical member and be connected together via a lever and locking nut.

The vertical member 110 may be a solid bar or a channel structure. The vertical member 110 has at least two holes 114 (one shown) near the opposite ends that attach the vertical member 110 to a vertical surface 100. In the embodiment shown in FIG. 5, the vertical member 110 includes an elongated tube 116 configured to receive a threaded nut 124. In one embodiment shown in FIG. 5, the elongated member 20 includes a rotating handle 120 with a threaded post 122. The threaded post 122 fits into a center bore formed on the elongated member 20 and connects to a threaded nut 124 placed inside the elongated tube or track 116. The elongated tube or track 116 and threaded nut 124 are configured to hold the threaded nut 124 in place allowing the user to tighten or loosen the rotating handle 120.

Figure 6:
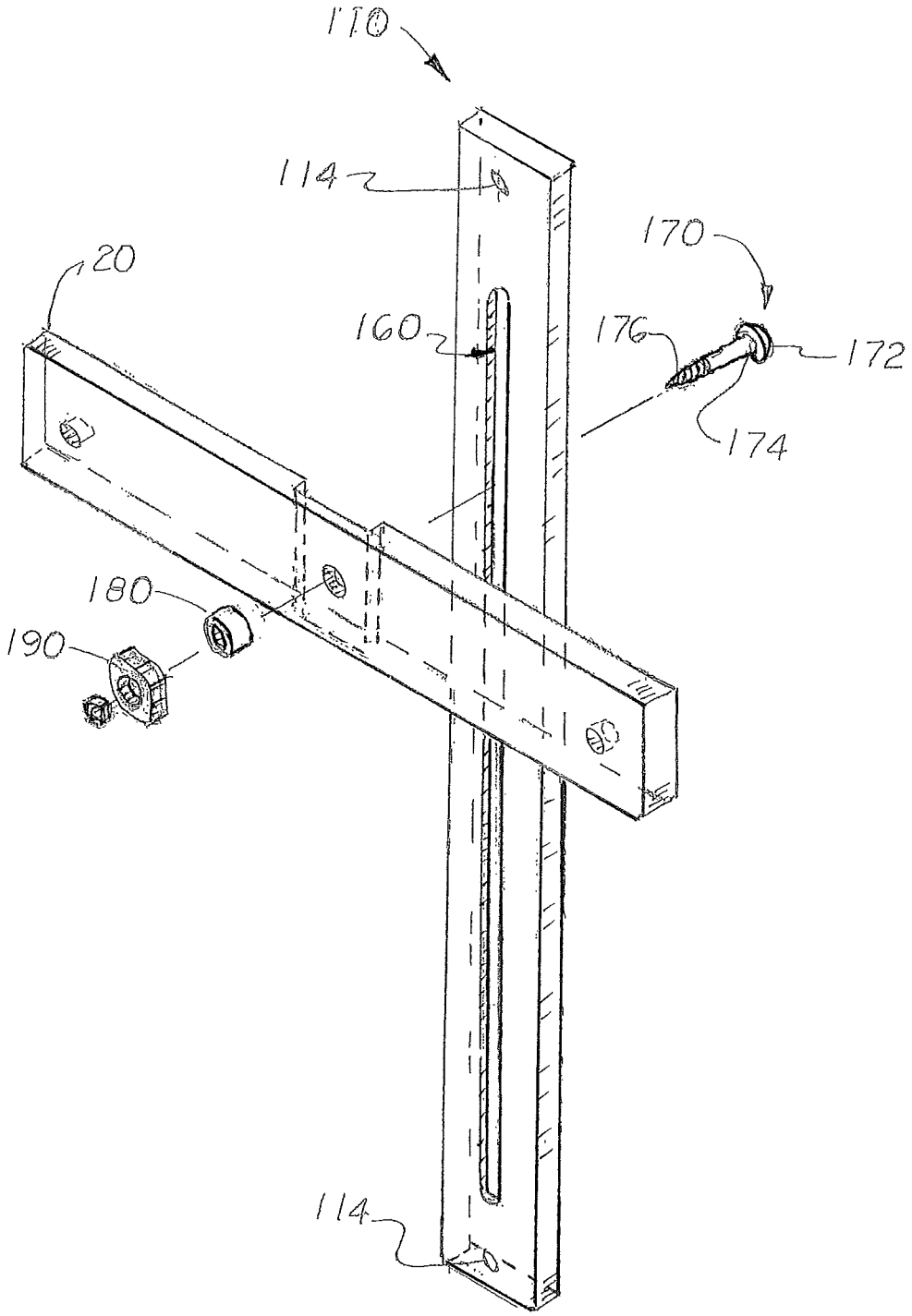
FIG. 6 is a partial perspective view of a channel-shaped elongated base attached to the vertical member by a carriage bolt that extends through a longitudinally aligned slot formed in the vertical member and through a hole formed in the elongated base.
Figure 7:
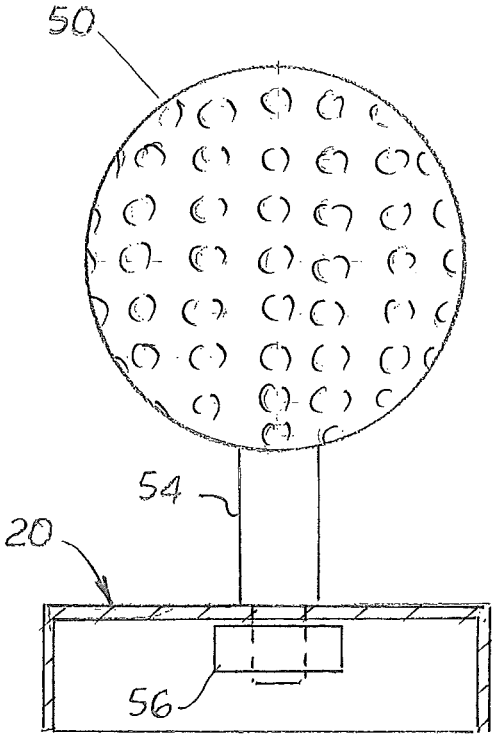
FIG. 7 is a sectional view of one end of a channel-shaped elongated base with the round member attached at one end.

In the embodiment shown in FIGS. 6 and 7, the rotating handle 120 and threaded post 122 is replaced by a carriage bolt 170 with a head 172 with adjacent flat flange surfaces 174. During assembly, the head 172 of the bolt 170 is extended into the slot 160. The size of the head 172 and the slot 160 are configured to allow the bolt 170 to slide freely inside the slot 160 and locked to prevent its rotation in the slot 160. The distal end of the bolt's threaded shaft 176 extends through the hole formed on the elongated member 20. A cylindrical spacer 180 and a threaded knob 190 are attached to the distal end of the threaded shaft 176.

Figure 2:
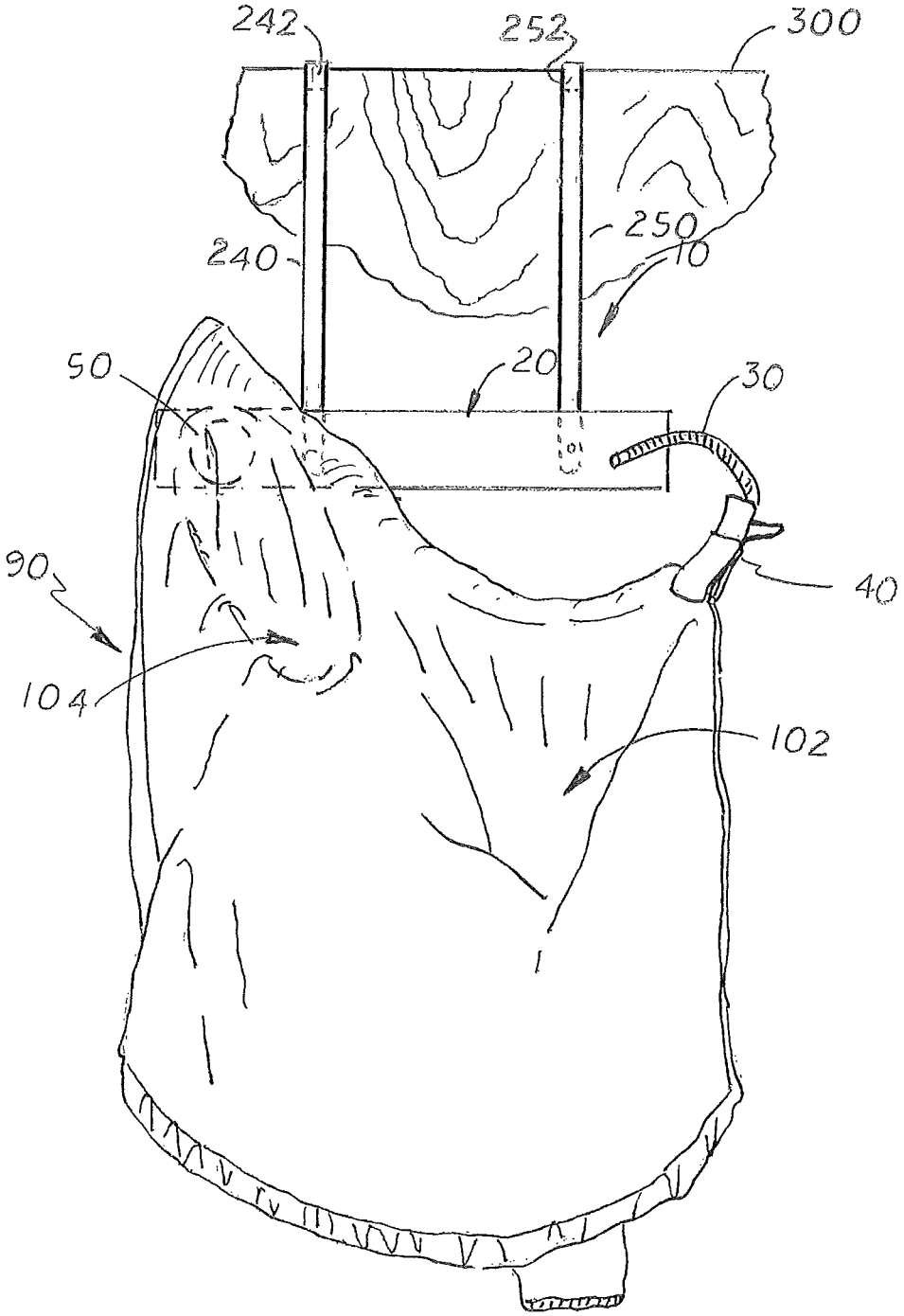
FIG. 2 is an illustration of the upper garment holding accessory hung from by two hangers that extend over the top edge of a door to hold the accessory over the vertical surface of the door and showing a coat attached to the round member and the clamping member repositioned so that the armholes are repositioned for use by a different user.
Figure 3:
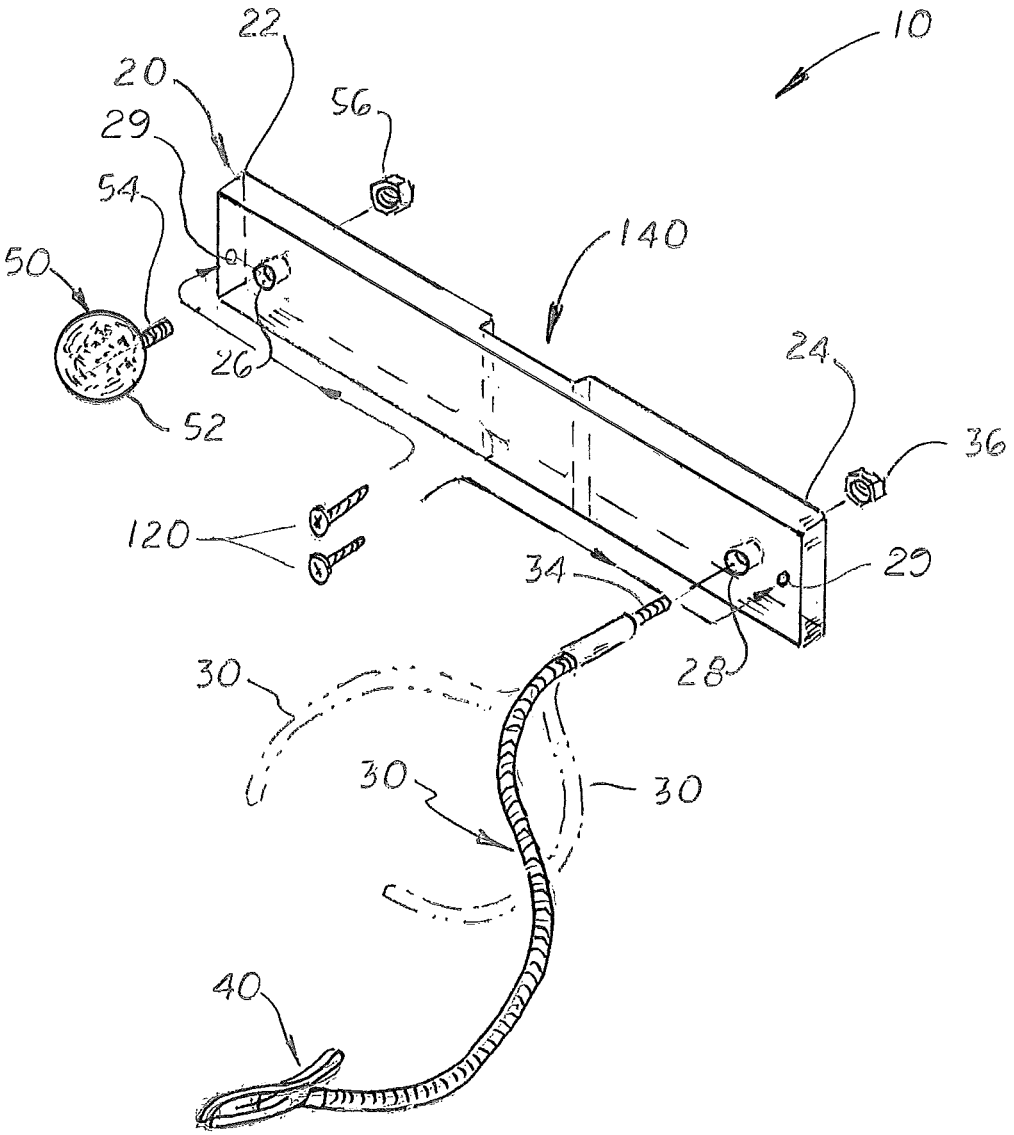
FIG. 3 is an exploded, perspective view of the upper garment holding accessory shown in FIGS. 1 and 2.
Figure 4:
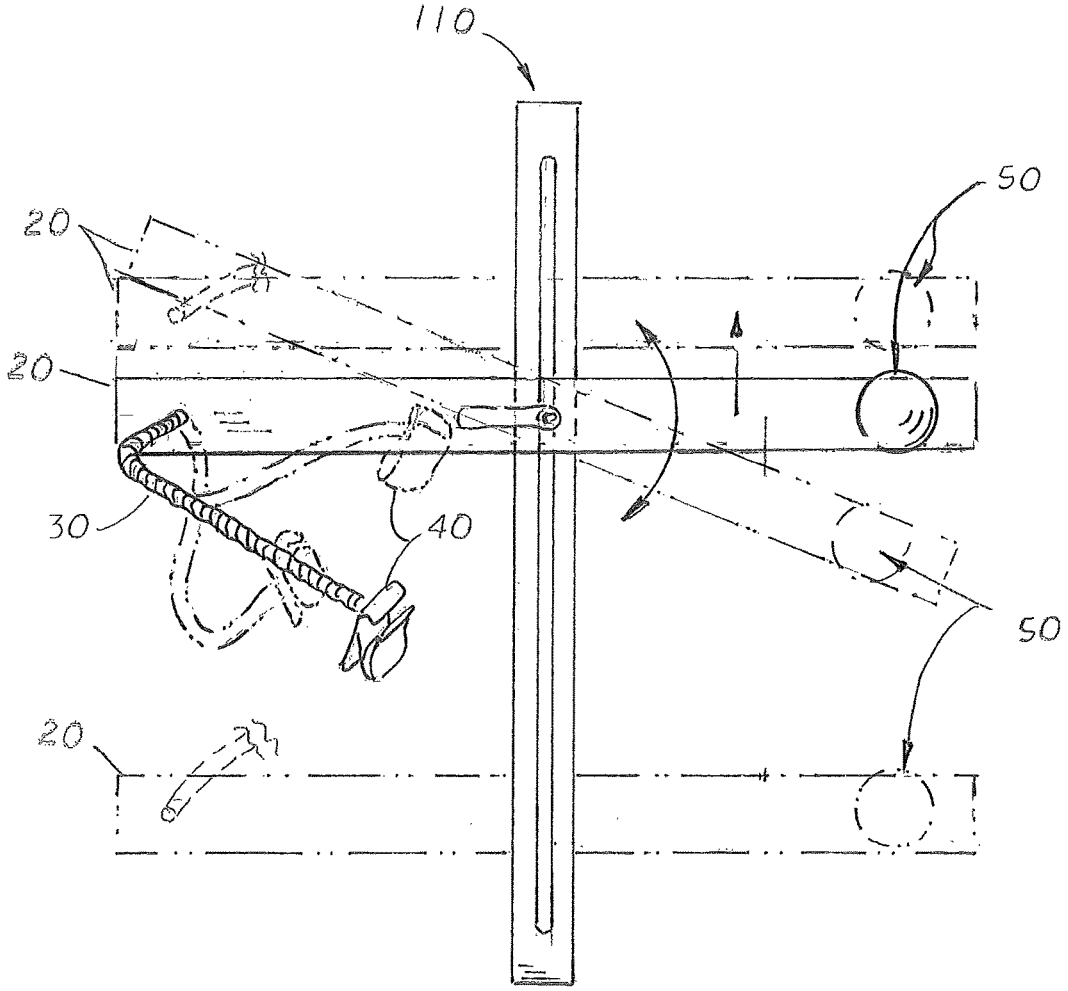
FIG. 4 is a front plan view of a second embodiment of the accessory that includes a vertical member with a longitudinally aligned slot that allows the bar-shaped elongated base to slide and affixed at different elevations on the vertical surface and if needed, tilted or rotated to change the relative locations of the clamping member and the round member.

In FIG. 2, the elongated bar 20 is a solid rectangular bar attached to two hangers 240, 250 each with hooks 242, 252, respectively, configured to extend over the top edge of a door 300.

Figure 8:
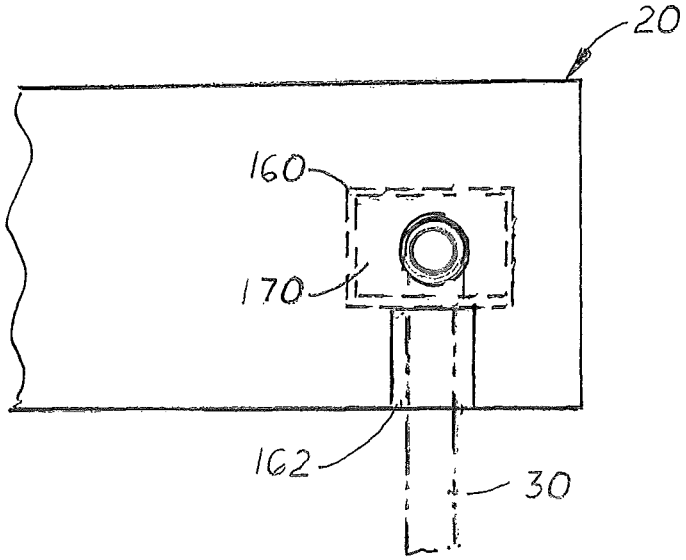
FIG. 8 is a front elevation view of another embodiment of the elongated base with a cavity formed on one end with a rotating threaded adapter inserted into the cavity that attaches the proximal end of the flexible arm enabling the user to rotate the flexible arm downward in a stored position.
Figure 10:
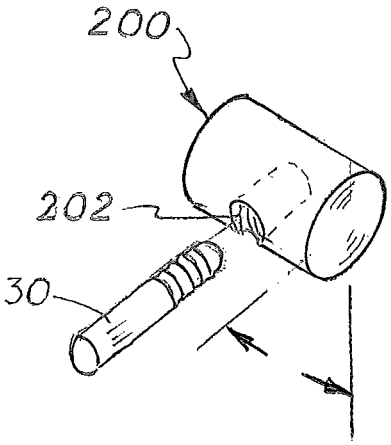
FIG. 10 is a perspective view of the threaded adapter shown in FIGS. 8 and 9.
Figure 9:
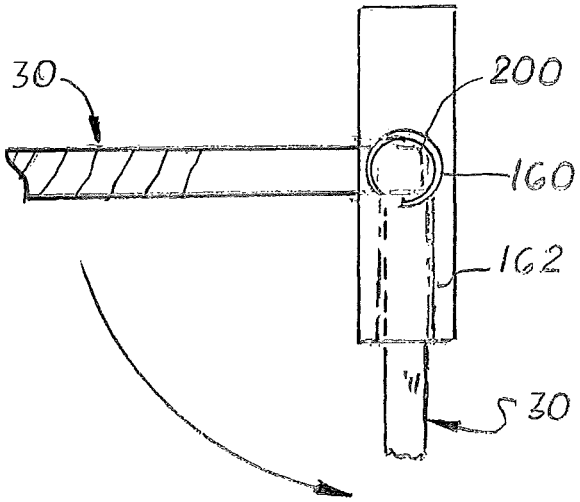
FIG. 9 is a side elevation view of the elongated base shown in FIG. 8 showing the flexible arm being rotated from a horizontal orientation to a vertical orientation.

The proximal end of the flexible arm 30 may be attached to a rotating cylindrical adapter 200 mounted on one end of the elongated base 20 enabling the flexible arm 30 to be selectively extended downward from the elongated base 20 and out of the way when not in use. FIG. 8 is a front elevation view of another embodiment of the elongated base 20 with a cavity 160 formed on one end with a rotating threaded adapter 200 inserted into the cavity 160. The adapter 200 includes a threaded bore 202 that attaches the threaded proximal end of the flexible arm 30 enabling the user to rotate the flexible arm 30 downward in a stored position. A channel 162 is formed on the elongated member 20 that accommodates the flexible arm 30 when rotated downward. FIG. 9 is a side elevation view of the elongated base 20 shown in FIG. 8 showing the flexible arm 30 being rotated from a horizontal orientation to a vertical orientation. FIG. 10 is a perspective view of the threaded adapter 200 shown in FIGS. 8 and 9.

During use, the elongated base 20 is mounted on a vertical wall or surface 100 or affixed on the vertical member 110 at an elevation at or near the user's shoulder height. The flexible arm 20 and round member 50 are attached to the elongated base 20. An upper garment 90 is positioned vertically adjacent to the elongated base 20. The upper garment 90 is turned so that its inside surface 98 is exposed and faces outward. The first armhole that is difficult to access by the user is identified. The upper garment's shoulder area or the lapel located above the first armhole is then extended over the round member 50. The upper garment 90 is then stretched to expose the first and second armholes. Usually the flexible arm 30 extends downward so the second armhole is below the first armhole allowing the user to slide the second arm downward into the second armhole. The clamping member 40 is then attached to the upper garment's front edge or lapel above the opposite armhole to hold the upper garment in a stretched position. The flexible arm 30 and the clamping member 40 may be independently bent or rotated to stretch the upper garment 90 so both armholes face outward and to a desired elevation and orientation.

In compliance with the statute, the invention described has been described in language more or less specific on structural features. It should be understood however, that the invention is not limited to the features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An accessory for holding an upper garment with its inside surface and two armholes exposed, said device including;

a. an elongated base that includes two opposite ends and a front surface;

b. a round member attached to one end of said elongated base and extending from the front surface of said elongated base, said round member includes an outer surface configured to support a shoulder, a collar or a lapel on the side of an upper garment and allow said upper garment to slide freely over said round member when a pulling force is exerted on said upper garment;

c. a flexible arm attached to said end of said elongated base opposite said end near said round member, said flexible arm extending from said front surface and configured to bend along an X, Y and Z axis and fixed in a desired position, said flexible arm includes a proximal end attached to said elongated base and a distal end; and, d. a biased clamping member attached to said distal end of said flexible arm, said biasing clamping member configured to temporarily grip the shoulder, collar or lapel on said upper garment opposite the shoulder, collar or lapel on the opposite side of said upper garment supported by said round member.

2. The accessory, as recited in claim 1, wherein said elongated base is 18 to 24 inches in length, said round member is approximately 1 to 3 inches in diameter and said flexible arm is 12 to 24 inches in length.

3. The accessory, as recited in claim 1, where said elongated base include two holes formed near its opposite end and two threaded connectors configured to attach said elongated base to a vertical support surface.

4. The accessory, as recited in claim 1, wherein said round member includes a threaded post that attaches to said elongated base.

5. The accessory, as recited in claim 1, wherein said flexible arm includes a plurality of interconnected twisting sections and a threaded post that attaches to said elongated base.

6. The accessory, as recited in claim 1, further including a vertical member attached to said elongated base and said support surface, said elongated base configured to rotate over said vertical member thereby enabling said elongated base to rotated 360 degrees over said support surface.

7. The accessory, as recited in claim 6, further including a slot formed in said vertical member and a threaded connector configured to extend through said slot and connect to a nut to attach said elongated base to said vertical member.

8. The accessory, as recited in claim 1, further including at least one vertical hanger configured to extend over the top edge of a door and over a vertical surface of a door and hold said elongated member over said vertical surface.

9. The accessory, as recited in claim 1, wherein said proximal end of said flexible arm is pivotally attached to said elongated base enabling said flexible arm to be extend forward from said elongated base or extended downward from said elongated base.

10. The accessory, as recited in claim 9, wherein said elongated base includes a rotating adapter connected to said proximal end of said flexible arm.

* * * * *